United States Patent [19]

Corey

[11] 4,312,431

[45] Jan. 26, 1982

[54] EXPANDABLE CARRYING CASE

[75] Inventor: Donald W. Corey, Wilbraham, Mass.

[73] Assignee: Beatrice Foods Co., Chicago, Ill.

[21] Appl. No.: 125,476

[22] Filed: Feb. 28, 1980

Related U.S. Application Data

[63] Continuation-in-part of Ser. No. 25,678, Mar. 30, 1979, abandoned.

[51] Int. Cl.[3] ..... A45C 7/00

[52] U.S. Cl. ..... 190/45; 190/48

[58] Field of Search ..... 190/44, 45, 48, 21, 190/22; 220/8; 150/0.5

[56] References Cited

U.S. PATENT DOCUMENTS

| | | | |
|---|---|---|---|
| 606,221 | 6/1898 | Kruppa et al. | 190/45 |
| 710,037 | 9/1902 | Bodwell | 190/45 |
| 1,045,390 | 11/1912 | Goldsmith | 190/44 |
| 2,078,624 | 4/1937 | Wolff | 190/44 X |
| 2,123,454 | 7/1938 | Doppelt | 190/48 |
| 2,880,902 | 4/1959 | Owsen | 220/8 |
| 4,153,146 | 5/1979 | Patton et al. | 190/44 |

FOREIGN PATENT DOCUMENTS

| | | | |
|---|---|---|---|
| 1104955 | 6/1955 | France | 190/45 |
| 76415 | 9/1961 | France | 190/44 |
| 327477 | 4/1930 | United Kingdom | 190/45 |

*Primary Examiner*—Donald F. Norton

*Attorney, Agent, or Firm*—Chapin, Neal & Dempsey

[57] ABSTRACT

A carrying case which has a telescoping wall structure for varying the carrying capacity of the case. The case has an articulated wall construction and includes a bottom section which is adapted to fit snugly for retention within the lower end of the top section without the use of fastener elements. The case is integrally formed with the top and bottom sections being interconnected by a flexible coupling panel.

2 Claims, 4 Drawing Figures

EXPANDABLE CARRYING CASE

This application is a continuation-in-part of my copending application Ser. No. 25,678 filed March 30, 1979, now abandoned, for Expandable Carrying Case and assigned to the same assignee as the instant application.

BACKGROUND

A popular type of carrying case for toilet articles includes side walls and a zippered upper portion formed by pivotable sections movable between horizontal and vertical positions for closing and opening the case. Examples of such cases are found in U.S. Pat. Nos. 2,123,454 to Doppelt and 2,561,042 to Arnold et al. Customarily such toilet cases are packed in suit cases and other luggage when traveling and it is desirable that the case be as compact as possible while at the same time having sufficient capacity to hold the usual toilet articles carried by an individual traveler. Of course, it will be realized that the size and variety of toilet articles carried by different individuals will vary widely and occasionally members of the same family will wish to pack their toilet articles in the same case. For maximum variability in capacity, attempts have been made to provide expandable toilet cases. Heretofore, such efforts have embodied bellows or accordian type pleats in the upright walls of the case, as disclosed in the Doppelt patent and U.S. Pat. No. 2,783,808 to Renz et al. While these constructions allow for some expansion in the capacity of these cases, the increases in capacity are relatively minor. Other prior art carrying cases, such as that shown in U.S. Pat. No. 606,221 to Kruppa et al are complicated in construction and generally cumbersome and unwieldly to operate. French Pat. No. 76,415 to Modiano also shows a collapsible carrying case wherein fasteners are employed within the case for holding the wall portions in telescoped relation.

Accordingly, it is a principal object of the present invention to provide an expandable carrying case which overcomes the deficiencies of the prior art.

It is another object to provide such a carrying case, the capacity of which is variable to a multiple extent.

It is another object to provide such a carrying case having a simple and economical construction and which requires the use of no fastener elements.

It is another object to provide a carrying case of the above type which may be readily expanded and collapsed.

DESCRIPTION OF THE DRAWINGS

These and other objects will become more readily apparent from the following detailed description taken in connection with the accompanying drawings in which.

DESCRIPTION OF THE PREFERRED EMBODIMENT

Figure 1:
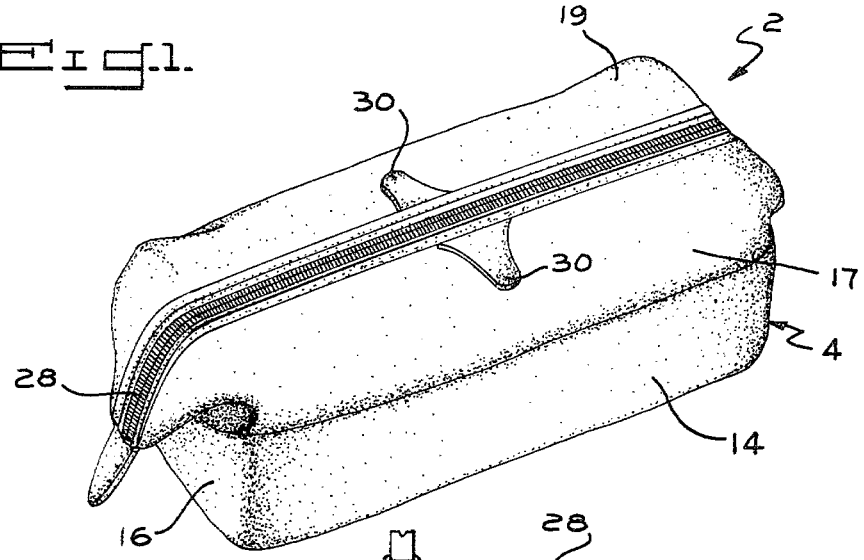
FIG. 1 is a perspective view of the carrying case of the present invention.

Referring to the drawings, a carrying case embodying this invention is shown generally at 2 and will be recognized in FIG. 1 as a toilet case of approximately conventional size and shape. Illustrated in this view is the top section 4 of an expandable multisectional case of unitary construction shown in fully expanded condition in FIG. 2. The case comprises the top section 4, bottom section 6 and a flexible intermediate section 8 which interconnects the opposed edges of the top and bottom sections. Each of these sections is rectangular in shape and is defined by upstanding side and end walls, which for the top section are shown at 14 and 16 in FIG. 1. The top section 4 also includes pivotable top wall portions 17 and 19 equipped with a zippered closure 28. The bottom section 6 includes base panel 20 and upstanding rectangularly arranged walls 22. From the upper edge of the walls 22, flexible wall panels 24 extend to the lower edges of the walls 14 and 16.

Figure 2:
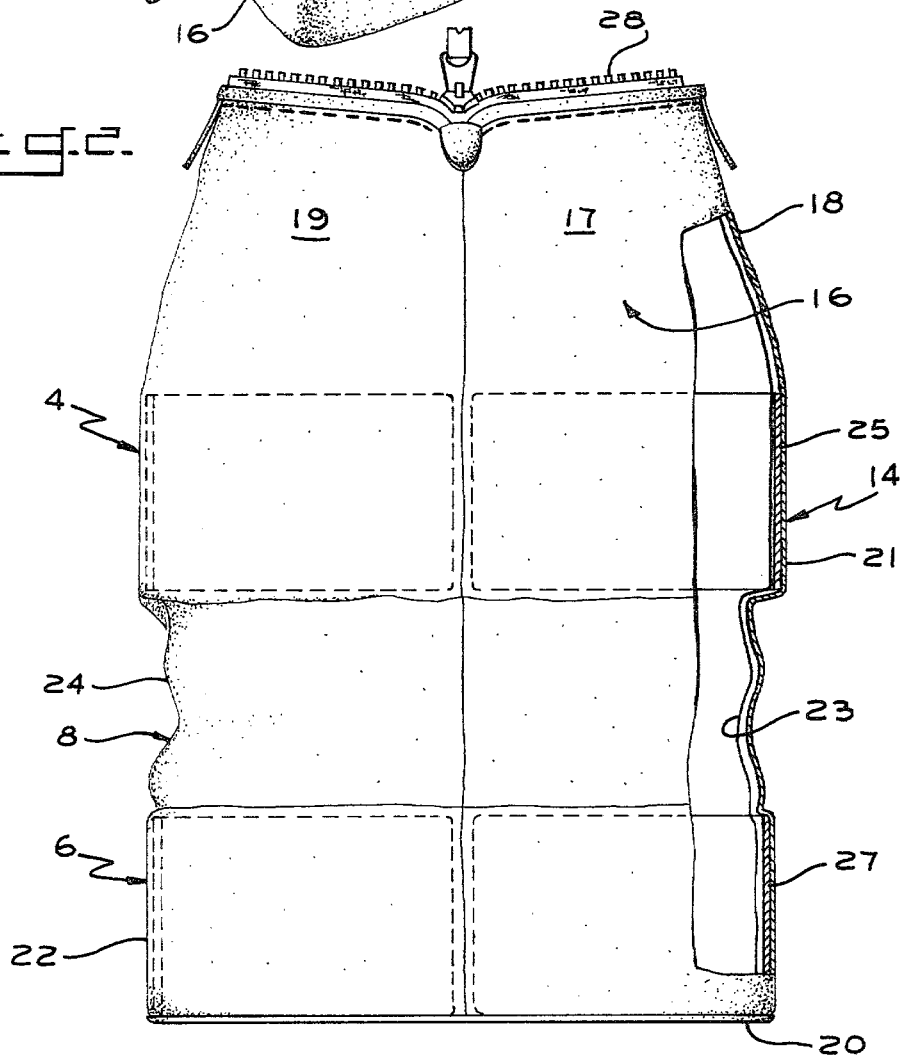
FIG. 2 is an elevational view of the carrying case of the present invention in an expanded, open condition, a portion of the case being broken away to show details of construction.
Figure 4:
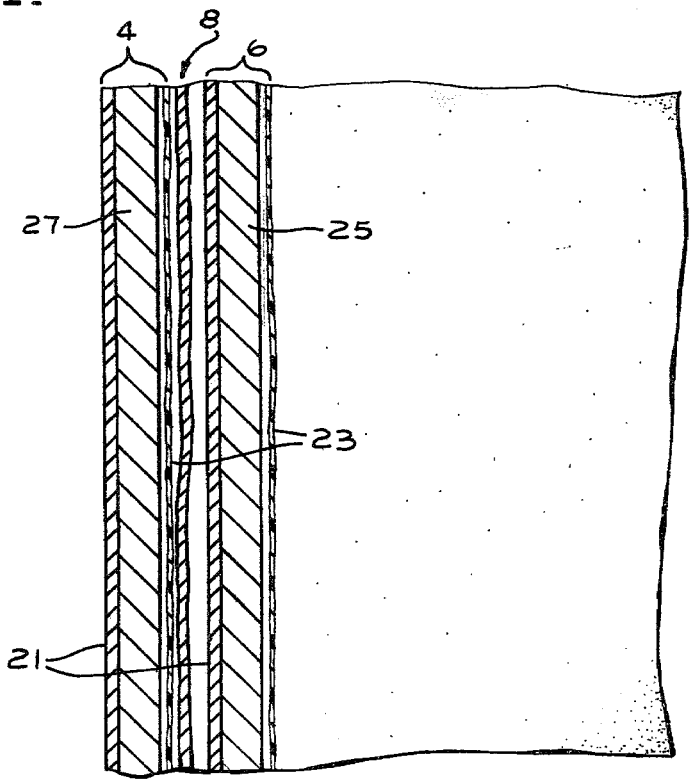
FIG. 4 is an enlarged, fragmentary, sectional view taken along line 4—4 of FIG. 3.

As best seen in FIGS. 2 and 4, the telescopic wall structure of the case is of multi-ply construction comprising an outer layer 21 of flexible material such as leather or a suitable synthetic plastic. A thin waterproof sheet material 23 such as synthetic plastic provides a liner for the interior of the case. Relatively rigid interliners or stiffeners 25 and 27 of any suitable material such as plastic, fiberboard or the like are disposed between the two flexible plies 21 and 23 forming the upright walls of the case. The stiffeners may be held in place by any suitable means such as by stitching or adhesive bonding to the inner surface of the outer ply. Each of the stiffeners consists of an elongated strip creased into a rectangular configuration corresponding to the cross sectional configuration of the case. Stiffener 25 corresponds in height to the height of the upright wall portion 14 of the top section of the case 4 and stiffener 27 corresponds in height to the upright wall portion 22 of the bottom section 6 of the case, as best shown in FIG. 2. The intermediate section 8 and the pivotable top wall sections 17 and 19 of the case include no such stiffeners and consist of a relatively flexible and pliable two ply construction as shown in FIG. 2.

Figure 3:
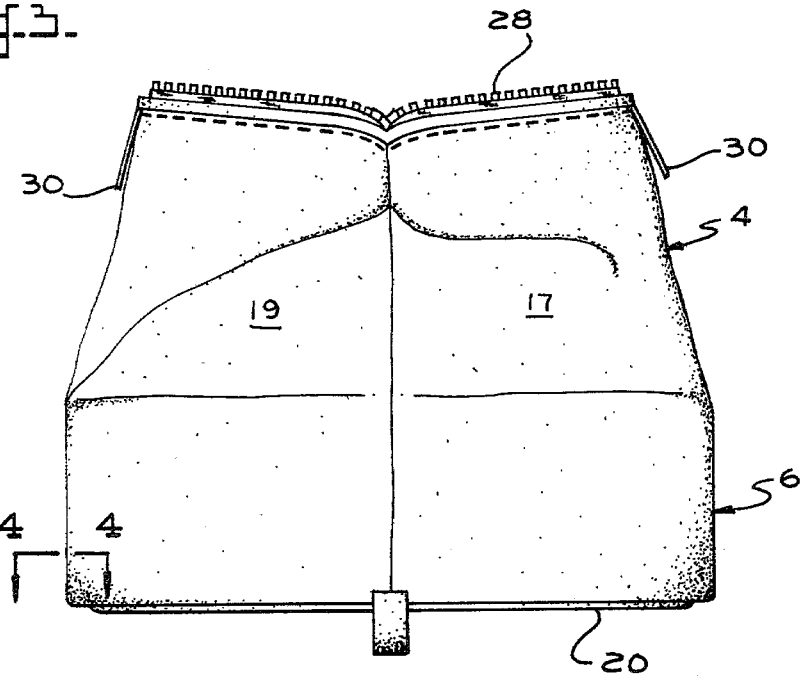
FIG. 3 is an elevational view of the carrying case in a contracted condition.

When the case is in its contracted or telescoped condition, FIGS. 1 and 3, it appears in all respects to be an ordinary toilet case of conventional type and size and when packed in a suitcase will take up no more space than the conventional toilet case. The top of the case may be opened or closed by the use of a zipper 28 affixed to the opposed edge portions of the pivotable top panels 17 and 19 of the case. The case may be opened, as shown in FIG. 3, by unzipping the zipper and pulling outwardly on the tabs 30 affixed along the edges of top panels 17 and 19. When the case is in its collapsed condition, as shown in FIG. 4, the lower and intermediate sections 6 and 8 are telescoped wholly within the lower end of the top section 4 wherein the upright wall portions of the three sections are disposed in coextensive relation one within the other. This telescopic arrangement is facilitated by the upright wall construction and relative dimensioning of the three sections of the case so that the lower section 6 fits within the upper section 4 with the flexible intermediate section 8 snugly wedged therebetween. As a result of this snug interfit of the three sections, frictional gripping forces serve to retain the sections of the case in telescoped condition. In this regard, the external dimensions of the lower portion 6 are somewhat smaller in size than the corresponding internal dimensions of the upper section 4 and while they will readily fit into the lower end of the upper section 4 with sufficient clearance therebetween to receive the reversibly folded intermediate section 8, as illustrated in FIG. 4, the sections tend to remain in their telescoped relation. This arrangement obviates the necessity of using any fasteners or retainers for holding the sections in telescoped relation. To further facilitate this interfit of the sections, the upright walls of top section 4 may be flared outwardly and/or the bottom section may be tapered inwardly. In addition, stiffeners 25 and 27 provided in the upper and lower sections of the case wall impart sufficient rigidity and form stability so that the bottom of the case 6 can be readily telescoped into the top of the case without buckling. Moreover, during the telescoping action of the rigid portions of the case, the pliant and flexible intermediate section 8 is readily carried upwardly by the lower section so as to be reversibly folded between the two relatively rigid portions. From its compact condition shown in FIG. 1 and 3, the case can be readily extended to its fully expanded condition by simply grasping the top and bottom sections with the hands and forcefully moving them in opposite directions to overcome the frictional gripping forces holding the three sections in telescoped relations. By doing this, the lower and intermediate sections are simply retracted from within the top section and assume the expanded condition shown in FIG. 2 in which the upright walls of the three sections are disposed in end-to-end generally coplanar relationship.

Inasmuch as this expandable toilet case includes alternate rigid and flexible wall sections, it will readily accommodate a large number and variety of irregularly shaped toilet articles, the flexible walls being somewhat deformable by the larger more rigid of such toilet articles.

Having thus described the invention, what is claimed is:

1. Expansible toilet case comprising top and bottom sections, each defined in part by upright walls, the external dimensions of one of said top and bottom sections being less than those of the other, an intermediate section interconnecting the lower end of said top section and the upper end of said bottom section, said intermediate section being composed of sufficiently pliable upright walls for enabling telescopic movement of said sections one within the other whereby the upright walls of said three sections are generally coextensive in height and the capacity of said case is related to the height of the top section, said bottom and intermediate sections being retractable from the top section for disposing said upright walls in end-to-end relation thus expanding said case to the cumulative height of the upright walls of said three sections, the upright walls of the top and bottom sections being relatively rigid in comparison to the intermediate section for facilitating the telescopic expansion and contraction of said three sections, said bottom section being smaller in cross section than the top section and being dimensioned relative thereto to enable telescopic movement of the bottom and intermediate sections within the top section in snugly fitted relationship, whereby the sections of the case are frictionally retained in telescoped condition without fasteners.

2. Expansible toilet case as set forth in claim 1 wherein the upright walls of said case are formed by a multi-ply construction having inner and outer plies of flexible sheet material, the upright walls of said bottom and top sections including stiffeners disposed between said plies.

* * * * *